United States Patent [19]

Nishi et al.

[11] Patent Number: 5,053,907

[45] Date of Patent: Oct. 1, 1991

[54] HYBRID RELAY

[75] Inventors: Hiroyuki Nishi; Takeshi Suzuki; Masato Nonaka, all of Nagaokakyo, Japan

[73] Assignee: Omron Tateisi Electronics Co., Kyoto, Japan

[21] Appl. No.: 494,805

[22] Filed: Mar. 14, 1990

Related U.S. Application Data

[63] Continuation of Ser. No. 310,160, Feb. 14, 1989, abandoned.

[30] Foreign Application Priority Data

Mar. 16, 1988 [JP] Japan ..... 63-64429
Aug. 30, 1988 [JP] Japan ..... 63-218186

[51] Int. Cl.[5] ..... H01H 9/30

[52] U.S. Cl. ..... 361/9; 361/13; 307/134

[58] Field of Search ..... 361/3, 6, 8, 9, 13, 361/102, 114; 307/134

[56] References Cited

U.S. PATENT DOCUMENTS 4,772,809 9/1988 Koga et al. ..... 361/13
4,802,051 1/1989 Kim ..... 361/13

FOREIGN PATENT DOCUMENTS 0146809 3/1985 European Pat. Off. .
1138473 10/1962 Fed. Rep. of Germany .

OTHER PUBLICATIONS

IEEE Transactions on Components, Hybrids, and Manufacturing, Krstic, S., et al., "Push-Button Hybrid Switch", vol. 9, No. 1, Mar. 1986, pp. 101-105.

*Primary Examiner*—Todd E. DeBoer
*Attorney, Agent, or Firm*—Fish & Richardson

[57] ABSTRACT

A hybrid relay comprising a mechanical relay provided with mechanical contact unit adapted to be actuated by an electromagnet, an electronic relay consisting of a semiconductor device, and a drive switch for supplying a drive current to the electromagnet, wherein the mechanical contact unit comprises: a first contact mechanism for controlling a load current of the hybrid relay; and a second contact mechanism for controlling a control current for a control gate of the semiconductor device; a contact point gap of the first contact mechanism being larger than that of the second contact mechanism. Thus, it is ensured that the first contact mechanism is engaged after the second contact mechanism and is disengaged before the second contact mechanism. Preferably, the mechanical contact unit further comprises a third contact mechanism, for controlling the leak current of the semiconductor device, which may be provided with a delay mechanism for delaying the returning action thereof. By maintaining the orders of engagement and disengagement of the three contact mechanisms, even when the load of the hybrid relay contains an inductive element, the generation of electric arcs in the first and third contact mechanisms is avoided. The addition of the delay mechanism simplifies the adjustment of the contact gaps of the three contact mechanisms.

3 Claims, 11 Drawing Sheets

HYBRID RELAY

This application is a continuation of U.S. application Ser. No. 07/310,160, filed Feb. 14, 1989, 1 now abandoned.

TECHNICAL FIELD

The present invention relates to a hybrid relay combining a mechanical relay for output control actuated by an electromagnet and an electronic relay consisting of a semiconductor device.

BACKGROUND OF THE INVENTION

Hybrid relays of this kind have been used for controlling the supply of electric current to inductive loads such as AC motors for the purpose of suppressing the generation of electric arcs when starting and stopping the supply of electric power to the loads. An example of such a hybrid relay is shown in FIG. 5.

The hybrid relay 101 is interfaced between an input signal circuit 102 and an output load circuit 103. The input signal circuit 102 comprises a control power source 104 and a drive switch 105 for producing an input signal for the hybrid relay 101. The output load circuit 120 comprises a load 110 such as an AC motor, and a load power source 111 such as an AC power source which is connected in series with the load 110. In the input end of the hybrid relay 101 are arranged a relay coil 106, a timer circuit 107 consisting of a resistor 121 and a capacitor 116 which are connected in series with one another, and a light emitting element 109 which forms a part of a photo-triac (triode alternating-current switch) 108, in mutually parallel relationship. In the output end of the hybrid relay 101 ar arranged a light receiving element 112 and a triac 113 which jointly form another part of the phototriac 108, an absorber circuit 114 for eliminating spurious pulse signals, and an output contact mechanism 115, and these circuit elements are connected across the load 110 and the load power source 111 in mutually parallel relationship.

When the switch 105 is turned on, the relay coil 106 is energized on the one hand and the light emitting element 109 receives a supply of electric power on the other hand. The energization of the relay coil 106 causes a conductive state of the output contact mechanism 115 and the light emitted from the light emitting element 109 brings the light receiving element 112 into conductive state with the result that the triac 113 turns into conductive state by receiving a voltage at its gate. However, since the photo-triac 108 operates electrically whereas the output contact mechanism 115 operates mechanically, the triac 113 turns into conductive state substantially before the output contact mechanism 115 does, and the output contact mechanism 115 therefore becomes conductive only after the output load circuit 103 has turned into conductive state due to the conduction of the triac 113, whereby the generation of electric arcs in the output contact mechanism 115 is avoided.

Conversely, when the switch 105 is turned off, the light emitting element 109 continues to emit light before the capacitor 116 of the timer circuit 107 is electrically discharged to a sufficient extent, so that the output contact mechanism 115 is disconnected while the triac 113 is still in conductive state. Thus, the triac 113 is brought into non-conductive state only after the output contact mechanism 115 is brought into non-conductive state, the generation of electric arcs in the load contact mechanism 115 is again avoided.

By preventing the generation of electric arcs in the output contact mechanism 115 as described above, the wear of the contact points is reduced and their durability is improved.

However, conventional hybrid relays have the following problems. First of all, when the switch 105 is turned on, the triac 113 becomes conductive before the output contact mechanism 115 does under normal condition, but, if the resistive value of a resistor 117 connected in series with the light emitting element 109 increases due to an increase in the ambient temperature, the conduction of the light receiving element 112 is accordingly delayed, and the relative timing of the conduction of the triac 113 and the output contact mechanism 115 may even reverse. In such a case, since the output load circuit 103 is brought into conductive state directly by the conduction of the output contact mechanism 115, electric arcs are generated at the contact points, and the basic function of the hybrid relay is totally lost.

Likewise, when the switch 105 is turned off, the timing of the operation of the photo-triac 108 may also be so unpredictable that the contact points of the output contact mechanism 115 may be disconnected after the triac 113 is brought into non-conductive state, and electric arcs may be produced in the output contact mechanism 115.

Further, the triac 113 conducts a small amount of current or leak current even when it is in its "nonconductive" state, and it is therefore preferable to disconnect the power line leading to the triac 113 to eliminate the waste of electric power and unnecessary heat generation from the triac 113 by using an auxiliary contact mechanism which may be combined with the output contact mechanism. The timing of disconnecting the power line leading to the triac must be properly arranged in relation with the connection of the output contact mechanism and the conduction of the triac so as not to disrupt the proper order of the switching actions of the output contact mechanism and the triac.

Furthermore, if the leak current is disconnected too soon after the disengagement of the output contact mechanism, electric arcs may be generated in the auxiliary contact mechanism for leak current control for the following reason. Now, a triac has the property to stay conductive once it has become conductive even after the gate voltage is reduced to "0" until the voltage across it is reduced to "0". Therefore, as shown in the graph of FIG. 6, if the timing $t_1$ of removing the gate voltage of the triac coincides with the timing T of applying "0" voltage across it, the triac immediately turns off and no problems arises, but, if the timing $t_2$ of removing the gate voltage falls between the adjoining timings T of applying "0" voltage across the triac, the triac stays conductive during the time interval h between the timing $t_2$ and the subsequent timing T, and the load circuit is kept in conductive state during that time interval. Therefore, if the auxiliary contact mechanism for shutting off the leak current is disconnected during the time interval h, electric arcs are generated in the auxiliary contact mechanism for shutting off the leak current.

Obtaining an appropriate timing of such three switching actions with a sufficient accuracy have not been possible with the prior art hybrid relays. It may be conceivable to prevent the generation of electric arcs in the auxiliary contact mechanism for shutting off the leak current by adjusting the contact gap of the auxiliary contact mechanism for it, but it is difficult to achieve because it must be carried out in consideration of the gaps of other parts of the contact mechanism, and the fine adjustment of the contact gaps is technically difficult.

Furthermore, if the edges of the pulse input from the drive switch to the relay coil are rounded, it becomes even more difficult to achieve a proper timing of the above mentioned switching actions because the time point of effective energization and de-energization of the electromagnet becomes uncertain.

BRIEF SUMMARY OF THE INVENTION

In view of such problems of the prior art, a primary object of the present invention is to provide a hybrid relay of the aforementioned type which ensures a proper timing between the switching actions of the output contact mechanism and the electronic relay so as to avoid the generation of electric arcs in the output contact mechanism.

A second object of the present invention is to provide a hybrid relay which effectively suppresses the leak current of the electronic relay without producing electric arcs between the contact points of the auxiliary contact mechanism for shutting off the leak current.

A third object of the present invention is to provide a hybrid relay whose operation would not be disrupted even when the input pulse signal thereto does not have sharp edges.

These and other objects of the present invention can be accomplished by providing a hybrid relay comprising a mechanical relay provided with mechanical contact means adapted to be actuated by an electromagnet, a semiconductor relay consisting of a semiconductor device, and switch means for supplying a drive current to said electromagnet, wherein said contact mechanism comprises: a first contact mechanism having a first contact point set for controlling a load current of said hybrid relay; and a second contact mechanism having a second contact point set for controlling a control current for a control gate of said semiconductor relay; a contact point gap of said first contact point set of said first contact mechanism being larger than a contact point gap of said second contact set of said second contact mechanism.

According to this structure, when the load current is to be conducted, the conduction takes place, first, at the second contact mechanism having the smaller contact gap to bring the electronic relay into conductive state and, then, the first contact mechanism having the larger contact gap is brought into conductive state to directly conduct the load current because of the difference in the contact gaps. Thereby, the generation of electric arcs in the first contact mechanism is avoided.

According to a preferred embodiment of the present invention, said mechanical contact means further comprises a third contact mechanism having a third contact point set for controlling a leak current of said semiconductor relay, a contact point gap of said third contact contact set being even smaller than said contact point gap of said second contact contact set. Owing to the appropriate selection of the contact gap of the third contact mechanism in relation to the contact gaps of the first and second contact mechanism, the third contact mechanism is brought into conductive state before the others, and is brought into nonconductive state later than others, whereby the leak current of the semiconductor relay is prevented without generating electric arcs in the third contact contact mechanism. In particular, by providing delay means for delaying the disengagement of the third contact mechanism, even more reliable elimination of leak current and electric arcs can be accomplished.

Such delay means may be conveniently realized when said contact mechanism comprises a pair of carriers which are capable of independent motion along their direction of action, and one of said carriers carrying said first and second contact contact sets is provided with pushing means for pushing the other carrier carrying said third contact contact set to its activated position for engaging said third contact contact set when said electromagnet is energized, said delay means comprising an auxiliary electromagnet which holds said other carrier at its activated position for a certain time interval after said one carrier has moved towards its initial position for disengaging said first and second contact contact sets when said electromagnet is de-energized. For simplicity and economy, the auxiliary electromagnet may be connected in parallel with the electromagnet for moving said carriers.

Alternatively, the delay means may comprise latch means which engages said other carrier at its activated position for engaging said third contact contact set and disengaging said other carrier from said activated position when said one carrier has returned a certain distance from its activated position for engaging said first and second contact contact sets towards said initial position thereof and unlatching means carried by said one carrier unlatches said latch means following de-energization of said electromagnet.

To the end of clearly defining the point of energization and de-energization of the electromagnet, the hybrid relay may comprise pulse edge conditioning means interposed between said electromagnet and said switch means for supplying a sharply increasing or decreasing drive signal to said electromagnet when it has received a drive signal from said switch means. This also contributes to achieving the proper timing of the two or three switching actions involved in the hybrid relay. cl

BRIEF DESCRIPTION OF THE DRAWINGS

Now the present invention is described in the following with reference to the appended drawings, in which.

DETAILED DESCRIPTION OF THE PREFERRED EMBODIMENTS

Now the present invention is described in the following in terms of specific embodiments with reference to the appended drawings. FIGS. 1 through 4 show a first embodiment of the hybrid relay of the present invention which is suitable for controlling the operation of a three-phase AC motor.

Figure 3:
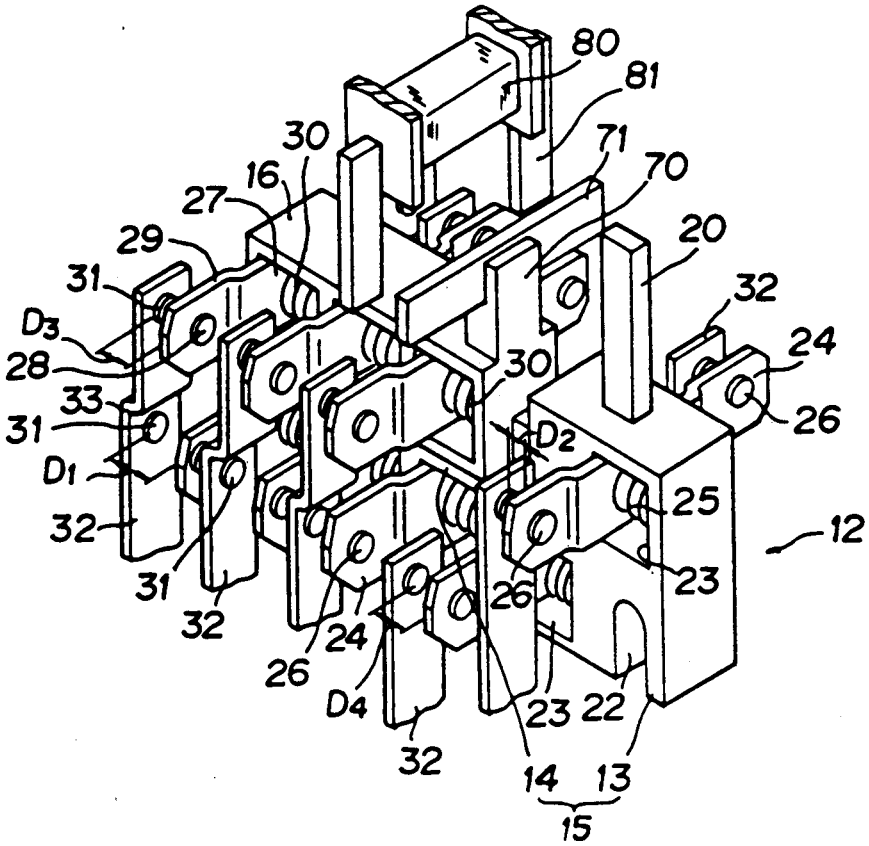
FIG. 3 is a perspective view of the contact mechanism of the hybrid relay shown in FIGS. 1 and 2.

This hybrid relay 1 comprises a casing 1 the interior of which is separated into three tiered spaces by horizontal partition walls 2 and 3. The lower space 4 accommodates an electromagnet consisting of a yoke 5, a core 6, a coil 7 and a spool 8, and an actuation rod 10 consisting of a rod pivoted at its lower end is provided opposite to an end surface of the core 6 defining a magnetic gap therebetween. The middle space 11 accommodates a contact mechanism 12 which is constructed as illustrated in FIG. 3.

The contact mechanism 12 comprises a first moveable block 15 which is L-shaped and consists of a base portion 13 and an extension 14, and a second moveable block 16 which is placed upon the extension 14 of the first moveable block 15. The positions of the first moveable block 15 and the second moveable block 16 are defined by the partition walls 2 and 3 with respect to the vertical direction and by the internal end surfaces of the barrier walls 17 which are provided perpendicularly to the contact mechanism 12 in mutually spaced relationship in the middle space 11 with respect to the lateral direction. The first moveable block 15 and the second moveable block 16 are normally biased in the direction indicated by an arrow A, respectively, by a pair of compression coil springs 18 and 19 which are interposed between the part of the casing 1 remote from the base portion 13 of the first moveable block 15 and the end surfaces of the corresponding moveable blocks 15 and 16, respectively.

A rod-shaped marker 20 projects integrally from the upper part of the base portion 13 of the first moveable block 15, and a cavity 22 is provided in the bottom part of the base portion 13 for receiving an actuation part 21 provided in the upper end of the actuation rod 10. Further, five laterally extending openings 23 are provided in the upper part of the base portion 13 and in the region extending from the base portion 13 to the extension 14 for receiving moveable contact pieces 24 therein, and each of the moveable contact pieces 24 received in these openings 23 is urged by a spring 25 away from the base portion 13 and against the inner wall surface of the opening 23, either lateral end of each of the moveable contact pieces 24 projecting laterally from the corresponding opening 23. Each of the laterally extending parts of the moveable contact pieces 24 is lightly bent so as to be offset from its middle part in parallel therewith and carries a contact point 26 which faces away from the base portion 13.

The second moveable block 16 is likewise provided with three openings 27 for receiving moveable contact pieces 29 therein, and each of the contact pieces 29 received in these openings 27 and carrying a contact point 28 at each lateral end portion is urged by a spring 30 away from the base portion 13 and against the inner wall surface of the opening 27. The openings 27 of the second moveable block 16 are arranged identically to the openings 23 of the extension 14 of the first moveable block 15 along the horizontal direction. And, the moveable contact pieces 24 and 29 consisting of identical component parts. Therefore, the moveable contact pieces 29 in the openings 27 are arranged identically to the moveable contact pieces 24 in the openings 23 along the horizontal direction.

Further, an armature mount portion 70 is integrally provided in the part of the upper end of the second moveable block 16 adjacent the base portion 13 of the first moveable moveable block 15, and a laterally extending armature 71 is mounted on this armature mount portion 70. The armature mount portion 70 and the armature 71 are passed through the partition wall 2 and protrude into the upper space 39.

On either side of the contact mechanism 12 in the middle space 11 are vertically arranged a plurality of fixed contact pieces 32 each carrying a pair of vertically spaced contact points 31 so as to oppose the contact points 26 and 28 of the aforementioned moveable contact pieces 24 and 29. The moveable contact pieces 24 and 29 received in the openings 23 and 27 of the first moveable block 15 and the second moveable block 16, respectively, which are aligned with respect to the horizontal direction, oppose the fixed contact pieces 32. Each of the fixed contact pieces 32 is provided with a bent portion 33 so as to produce an offset between its upper and lower parts in parallel relation each other, and carries a pair of contact points 31, one above the bent portion 33 and the other below the bent portion 33. Due to the provision of the bent portions 33, the contact points 31 above the bent portions 33 are closer to the contact points 28 of the corresponding moveable contact pieces 29 than the contact points 31 below the bent portions 33 are to the contact points 31 of the corresponding moveable contact pieces 24, and the gap D1 between the contact points 26 and 31 is thus larger than the gap D3 between the contact points 28 and 31 when the electromagnet 9 is in its de-energized state.

Further, the gap D2 between the contact points 26 and 31 which are provided in the moveable contact piece 24 received in the opening 23 in the upper part of the base portion 13 of the first moveable block 15 and the fixed contact piece 32, respectively, is selected to be intermediate between the gaps D1 and D3 so that the relationship $D3<D2<D1$ holds. The gap D4 between the contact points 26 and 31 of the moveable contact piece 24 received in the opening 23 of the lower part of the base portion 13 and the fixed contact piece 31, respectively, is selected to be substantially identical to the gap D1. The contact point sets having the contact gap of D4 are provided for the purpose of lighting an indicator lamp and others which are not directly related to the operation of the hybrid relay.

The upper space 39 accommodates a printed circuit board 40 therein for mounting a photo-triac, an absorber circuit and so forth thereon. In the upper space 39, an auxiliary electromagnet 80 is mounted on the lower surface of the casing 1, and is provided with a yoke 81 which opposes the armature 71 provided in the upper part of the second moveable block 16 in close proximity.

Five pairs of terminal bases 41 are provided on either side of the upper surface of the casing 1; the three pairs of the terminal bases 41 opposing the second moveable block 16 are connected to leads 42 extending from the three fixed contact pieces 32 opposing the moveable contact pieces 24 and 29 carried by the second moveable block 16 and the extension 14 of the first moveable block 15, the pair of terminals bases 41 adjacent thereto are connected to leads 42 extending from the fixed contact pieces 32 opposing the moveable contact piece 24 received in the opening 23 provided in the lower part of the base portion 13 of the first moveable block 15, and the remaining pair of terminals bases 41 are connected to leads extending from the coil 7. The three pairs of the terminal bases 41 are connected to the load, the adjacent pair of terminals bases 41 are connected to a monitor unit, and the remaining pair of terminals bases 41 are connected to the input signal control unit.

Figure 4:
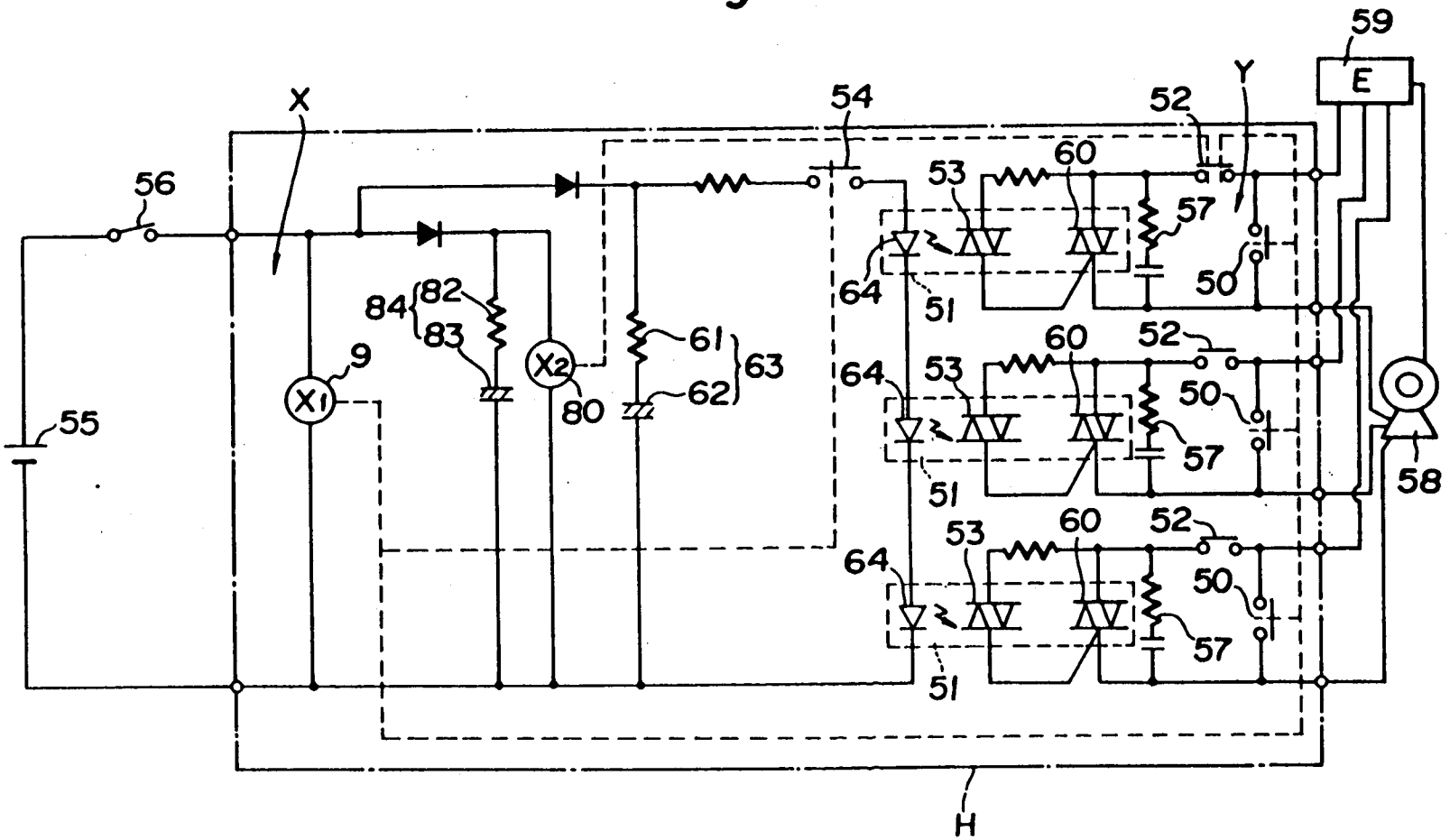
FIG. 4 is a circuit diagram of the hybrid relay of the first embodiment.

The circuit structure of the above described embodiment is described in the following with reference to FIG. 4. In this drawings, symbol H denotes the hybrid relay which interfaces an input signal circuit X and a load circuit Y.

The load circuit Y end of the hybrid relay H comprises three sets of identical circuit units, arranged in mutually parallel relationship and each comprising an output contact mechanism 50, an absorber circuit 57, a triac 60 and a light receiving element 53, which form individual photo-triacs 51, and is further provided with three second contact mechanisms 52 for shutting off the leak current of the photo-triac 51, each connected between the corresponding photo-triac 51 and a common load which consists of a three-phase AC motor 58 and an AC power source 59 connected in series with the latter. As these circuit units are identical to each other, only one of them is described in some of the following description.

Meanwhile, the input signal circuit X end of the hybrid relay H is provided with the electromagnet 9 and the auxiliary electromagnet 80 which are connected in mutually parallel relationship, and a second contact mechanism 54 and three light emitting elements 64 are connected in mutually serial relationship but in parallel relationship to the electromagnets 9 and 80. A second delay action circuit 84 consisting of a serial connection of a second limit resistor 82 and a second delay action capacitor 84 is connected in parallel with the auxiliary electromagnet 80, and a first delay action circuit 63 consisting of a serial connection of a second limit resistor 61 and a second delay action capacitor 62 is connected in parallel with the light emitting element 64. In the input signal circuit X, numerals 55 and 56 denote a control power source 55 and a drive switch 56, respectively.

An output contact mechanism or a first contact mechanism 50 is formed by the contact points 26 and 31 defining the contact gap of D1, the third contact mechanism 52 is formed by the contact points 28 and 31 defining the contact gap of D3, and the second contact mechanism 54 is formed by the contact points 26 and 31 defining the contact gap of D2.

Now the operation of the above described hybrid relay H is described in the following.

(1) Conducting Load Current

Figure 1:
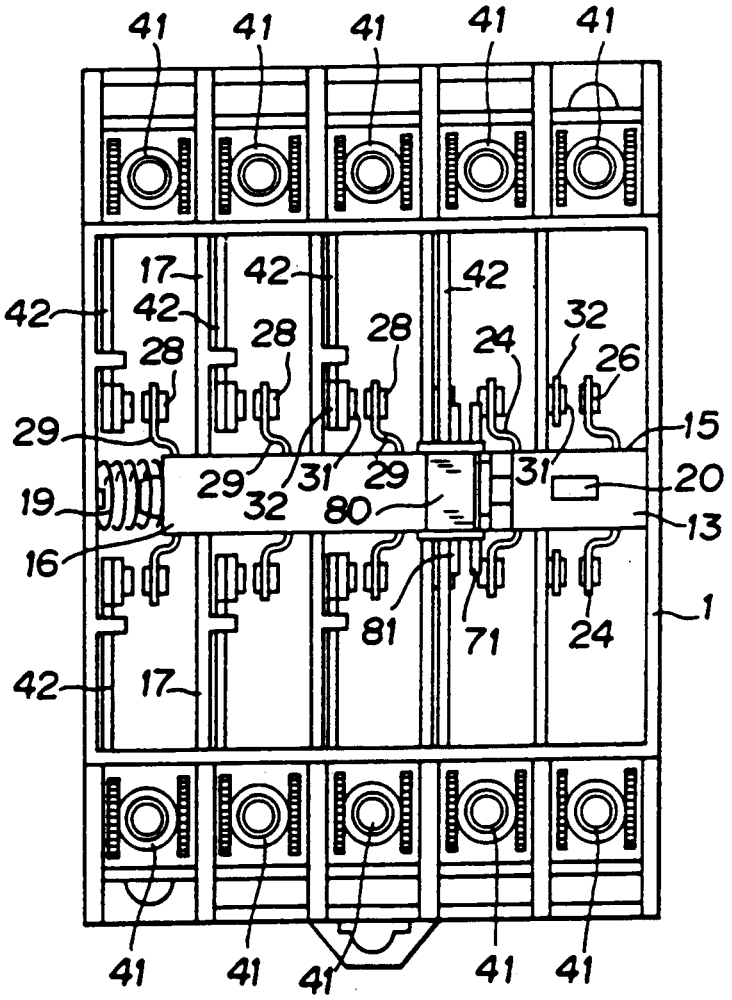
FIG. 1 is a plan view of the first embodiment of the hybrid relay according to the present invention.
Figure 2:
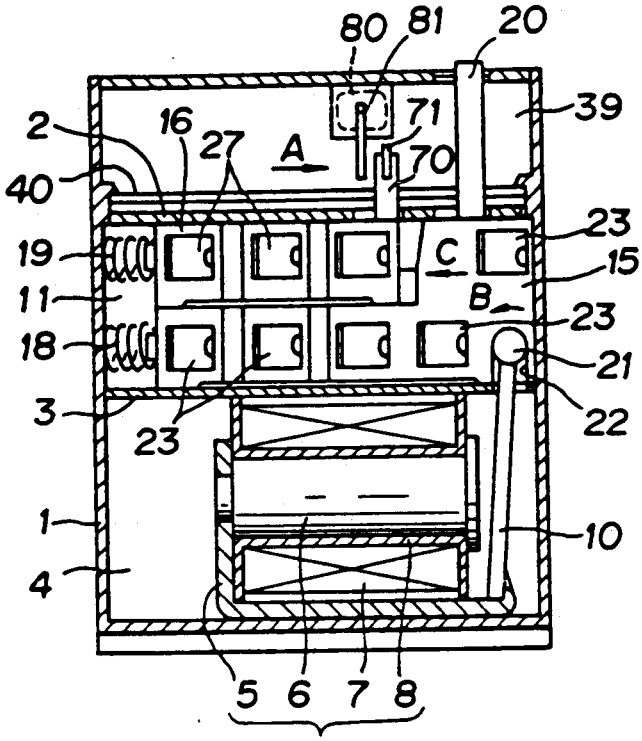
FIG. 2 is a vertical sectional view of the hybrid relay shown in FIG. 1.

When the drive switch 56 is turned on, the electromagnet 9 is energized, causing the actuation rod 10 to be attracted to the core 6 and rotate in the direction indicated by an arrow B (FIG. 2). Since the actuation portion 21 is received in the cavity 22, the first moveable block 15 is moved in the direction indicated by an arrow C against the biasing force of the spring 18, and the second moveable block 16 is also moved in the direction indicated by the arrow C against the biasing force of the spring 19 pushed by the first moveable block 15. First of all, the contact points 28 and 31 belonging to the third contact mechanism 52 and having the smallest contact gap D3 come into mutual engagement, the contact points 26 and 31 belonging to the second contact mechanism 54 and having the contact gap of D2 then comes into mutual contact, and the contact points 26 and 31 belonging to the first contact mechanism 50 and having the largest contact gap of D1 as well as the contact points 26 and 31 having the contact gap of D4 come into mutual contact.

Following the motion of the first moveable block 15, the armature 71 mounted on the top thereof is brought into contact with the yoke 81 of the auxiliary electromagnet 80 and, since the auxiliary electromagnet 80 is also energized by turning on the switch 56, the armature 71 is kept attached to the yoke 81.

As described above, following the connection of the third contact mechanism 52 and the subsequent connection of the second contact mechanism 54, the photo-triac 51 is activated and the load circuit Y becomes conductive due to the conduction of the triac 60. Since the first contact mechanism 52 is connected thereafter, the generation of electric arcs is avoided when the contact points 26 and 31 of the first contact mechanism 50 are brought into mutual contact. Some leak current is conducted to the photo-triac 51 light receiving element 53 when the contact points 26 and 31 of the third contact mechanism 52 are brought into mutual contact, but the amplitude of this current is so small that no electric arcs will be produced therefrom.

By thus establishing the conductive state in each of the first contact mechanisms 50, the three-phase AC motor 58 connected to the corresponding terminal bases 41 is activated, and the contact between the contact points 26 and 31 of the contact mechanism having the contact gap of D4 causes a monitor lamp connected to the corresponding terminal bases 41 to be lighted up. The movement of the first moveable block 15 is clearly indicated by the marker 20 for visual inspection from outside.

(2) Shutting off Load Current

When the switch 56 is turned off, the electromagnet 9 is de-energized and the core 6 loses its attractive force. As a result, the pressure from the actuation portion 21 of the actuating rod 10 upon the first moveable block 15 is released. Therefore, the first movable block 15 and the second moveable block 16 are returned to their initial positions by the springs 18 and 19.

Here, the first moveable block 15 is smoothly returned to its initial position without any restraint, but the returning motion of the second moveable block 16 is delayed because the armature 71 is kept attached to the yoke 81 for some time while the auxiliary electromagnet 80 retains its energized state due to the electric charge stored in the second delay action capacitor 83. The second moveable block 16 is released for its returning motion only when the second delay action capacitor 83 is sufficiently discharged.

In this case, as opposed to the case where the load current is about to be supplied, first of all, the contact points 26 and 31 belonging to the first contact mechanism 50 and having the largest contact gap D1, as well as the contact points 26 and 31 having the contact gap of D4, are disengaged from one another, the contact points 26 and 31 belonging to the second contact mechanism 54 and having the contact gap of D2 are then disengaged from one another, and, lastly, the contact points 28 and 31 belonging to the third contact mechanism 52 and having the smallest contact gap of D3 are disengaged from one another.

In the above described case, since the light emitting element 64 continues to receive a supply of electric power before the first delay action capacitor 62 is sufficiently discharged, the first contact mechanism 50 is disconnected only after the load circuit Y is brought into the conductive state by the conduction of the triac 60, and the generation of electric arcs in the first contact mechanism 50 is avoided.

Figure 6:
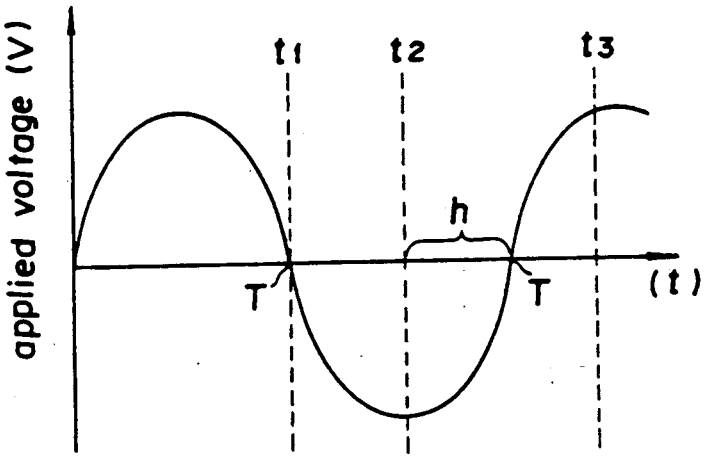
FIG. 6 is a graph showing the time history of a transition of the state of a triac from conductive state to nonconductive state.
Figure 7:
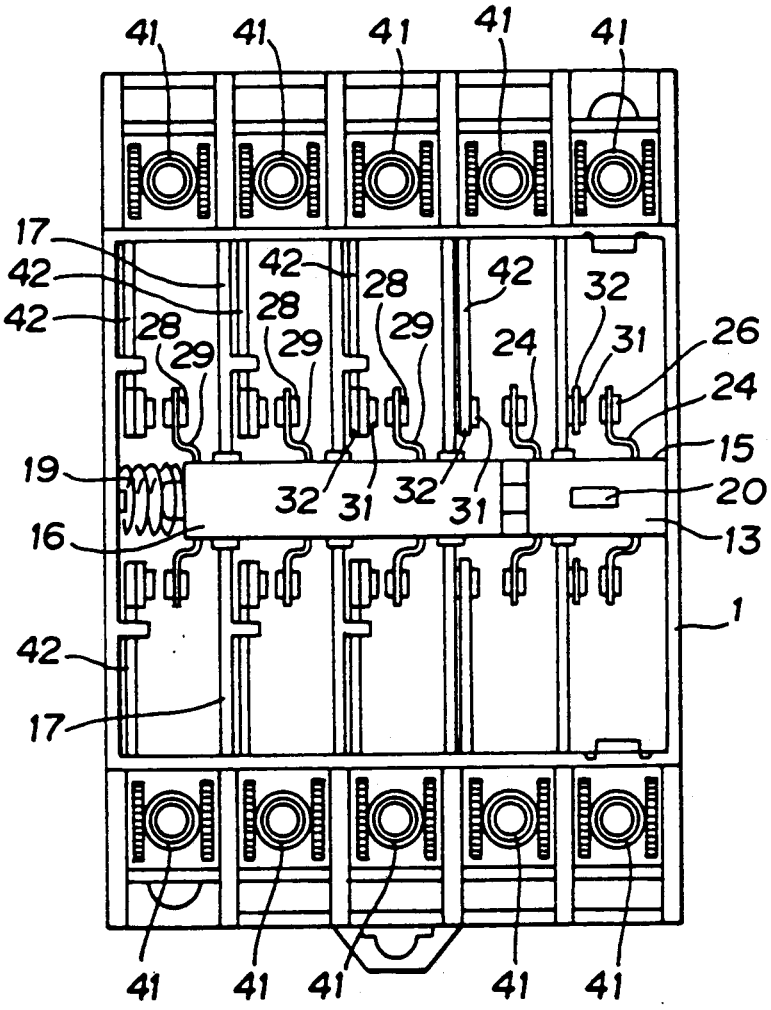
FIG. 7 is a plan view showing a second embodiment of the hybrid relay according to the present invention.
Figure 8:
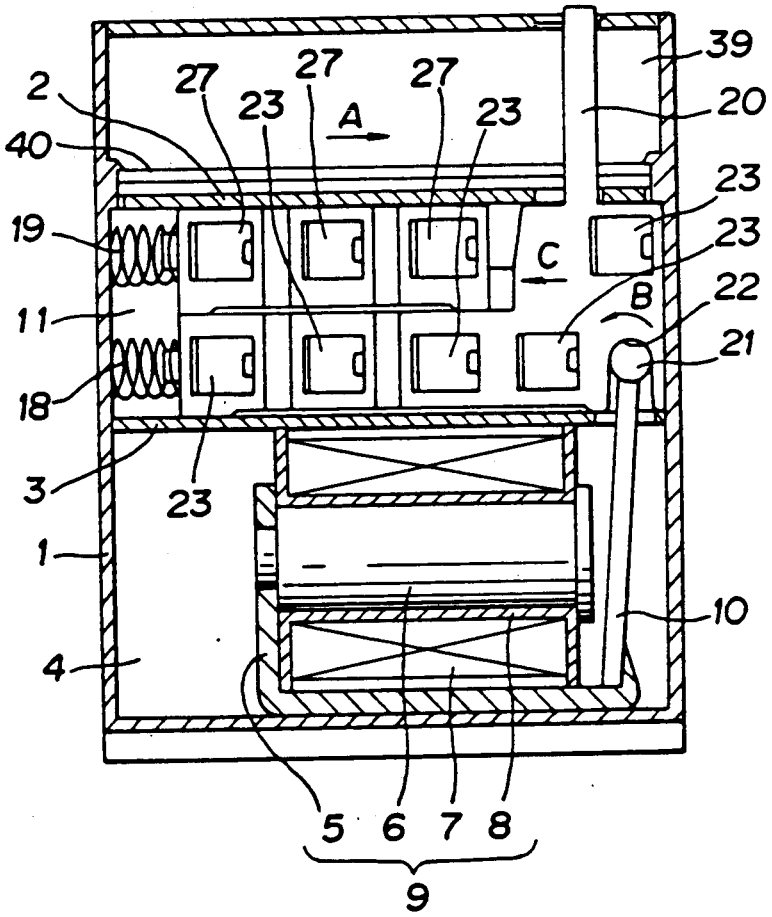
FIG. 8 is a vertical sectional view of the second embodiment of the present invention.
Figure 9:
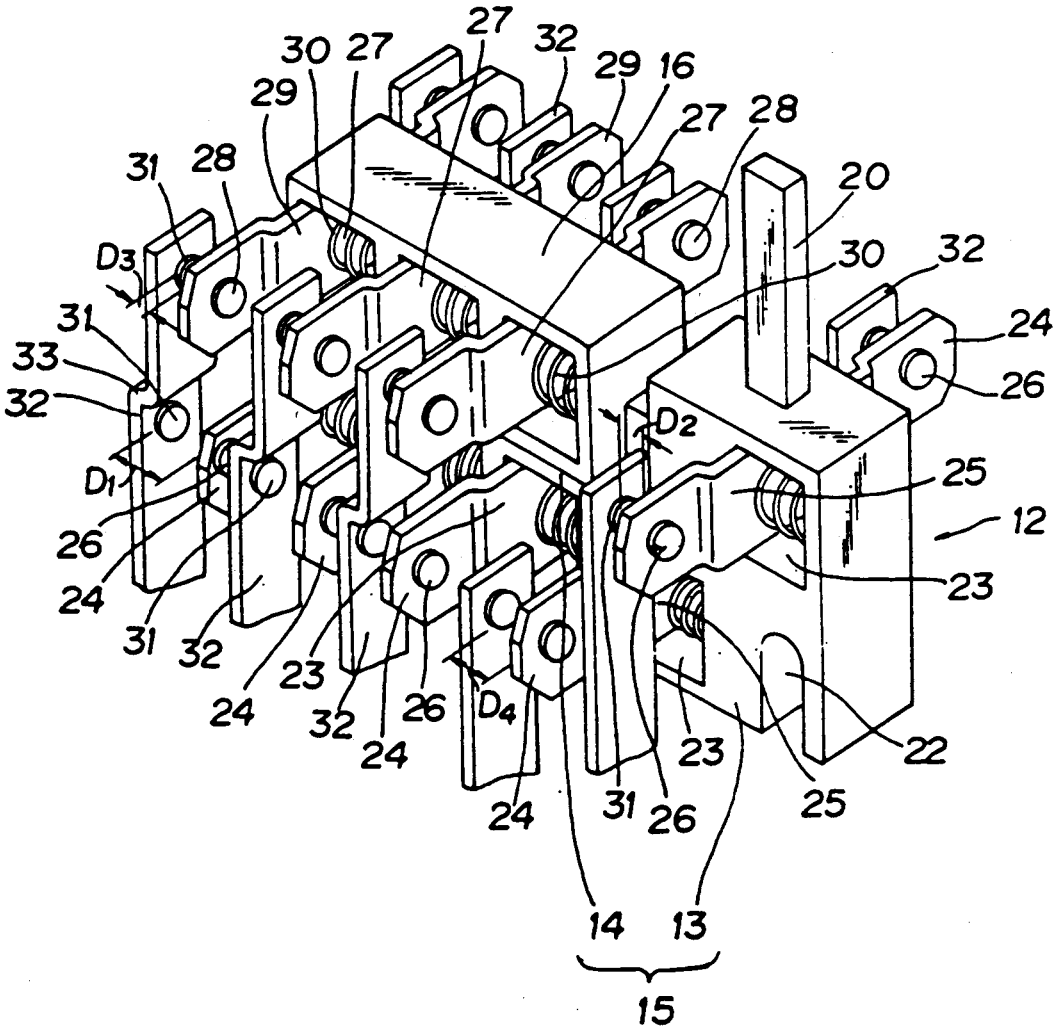
FIG. 9 is a perspective view of the contact mechanism of the hybrid relay of the second embodiment of the present invention

The third contact mechanism 52 is disconnected last of all as described above. Further, owing to the action of the auxiliary electromagnet 80, the returning action of the first moveable block 16 takes place some time after the disengagement of the second contact mechanism 54. Therefore, as shown in FIG. 6, even when the timing T of the photo-triac 51 becoming nonconductive is later than the timing t2 of disengaging the second contact mechanism, since the timing of the disengagement of the third contact mechanism t3 occurs thereafter, the third contact mechanism 52 is disconnected only after the load current of the load circuit Y has been reduced substantially to zero by the triac 60 turning into non-conductive state, the generation of electric arcs in the third contact set 52 is again avoided.

FIGS. 7 through 13 show the second embodiment of the hybrid relay according to the present invention. The parts corresponding to those of the previous embodiment are denoted with like numerals.

This embodiment is similar to the previous embodiment, but differs from the latter in regards to the structure of the delay mechanism for delaying the disengagement of the third contact mechanism 52. In this embodiment, the armature mount portion 70, the armature 71, the auxiliary electromagnet 80, the yoke 81, and the delay circuits 63 and 84 are absent. Instead, the second moveable block 16 is provided with a laterally open cavity 34 accommodating a latch member 35 which is urged outwardly by a compression coil spring 36. Each of the internal ends of the barrier walls 17 is provided with a striker portion 38 which is adapted to engage with the corresponding latch member 35. Further, an unlatch member 37 is provided in the extension 14 of the first moveable block 15 for disengaging the latch member 35 from the strike portion 38.

Figure 10:
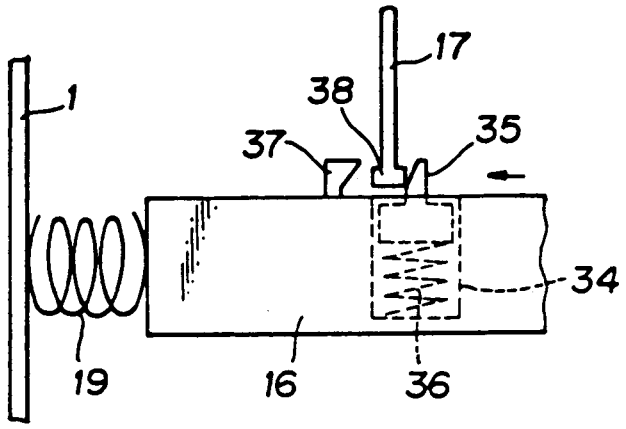
FIGS. 10 through 12 are fragmentary side views of the delay mechanism incorporated in the hybrid relay of the second embodiment of the present invention in different stages of its operation.
Figure 11:
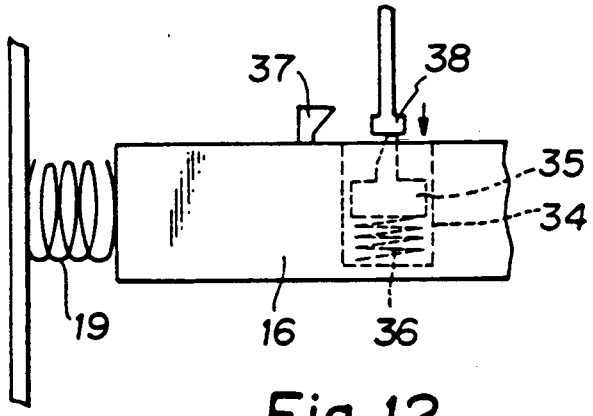
Figure 12:
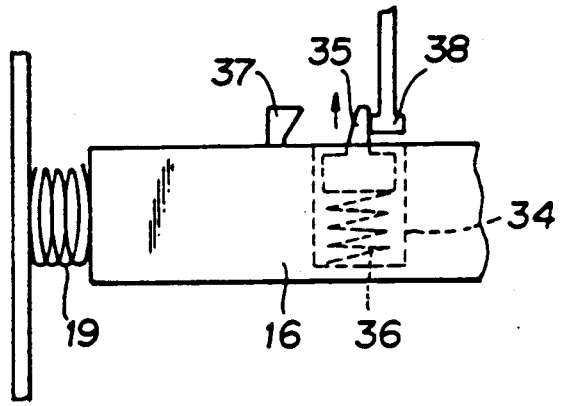
Figure 13:
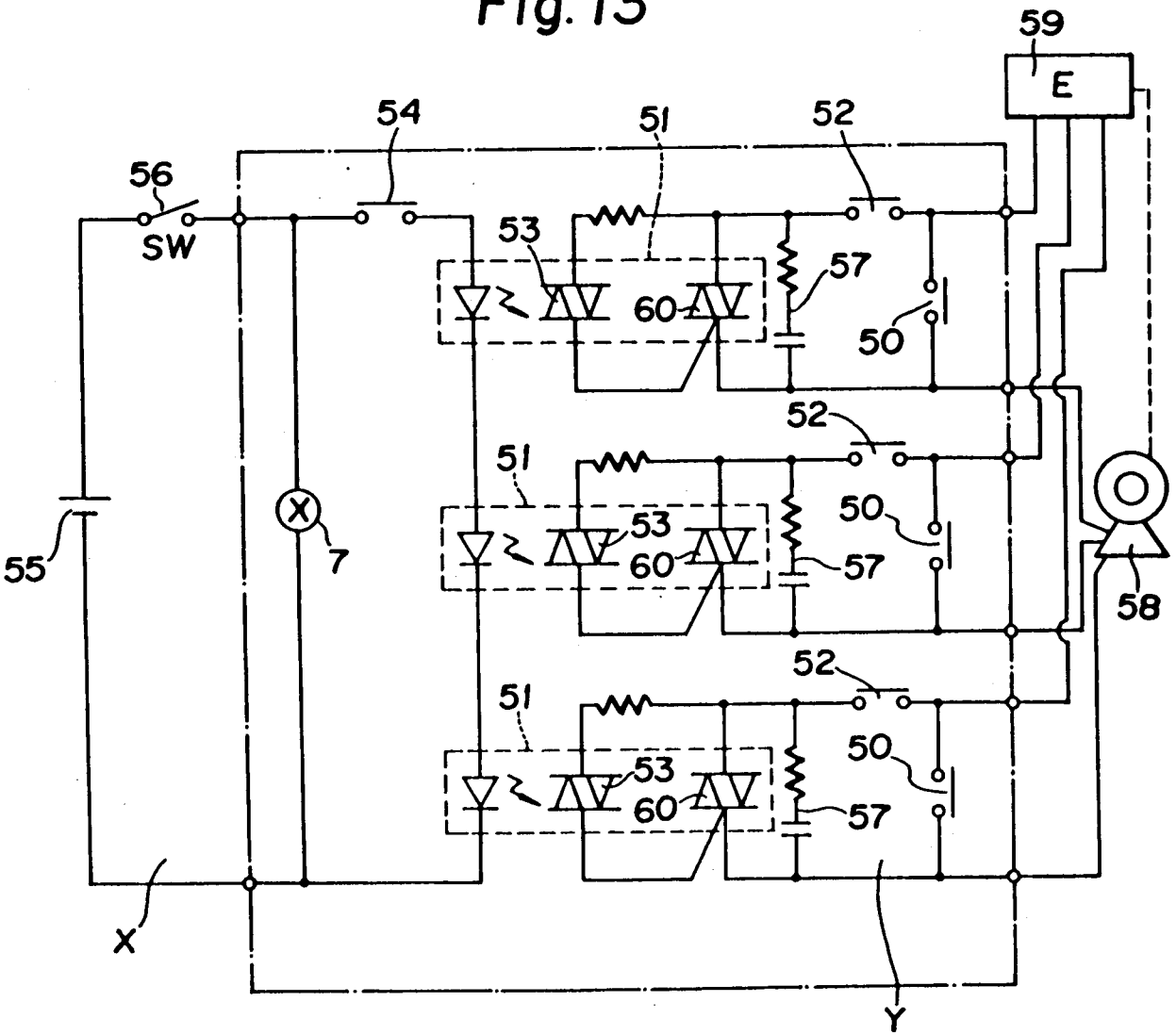
FIG. 13 is a circuit diagram of the hybrid relay of the second embodiment.

According to this embodiment, when the electromagnet 9 is energized and the first and second moveable blocks 15 and 16 are moved against the spring forces of thee electromagnet 9 is energized and the first and second moveable blocks 15 and 16 are moved against the spring forces of the compression coil springs 18 and 19, the latch member 35 is pushed into the cavity 34 by the striker portion 38 against the spring force of the compression coil spring 36 since the inclined surface of the latch member 35 contacts the striker portion 38 as shown in FIGS. 10 and 11. When the second moveable block 16 has moved all the way to its activated position along with the first moveable block 15, the latch member 35 projects from the cavity 34 under the spring force of the compression coil spring 36 and becomes engaged by the striker portion 38 with the straight surface of the latch member 35 contacting the striker portion 28 as shown in FIG. 12. When the electromagnet 9 is de-energized, the first moveable block 15 can return without any restraint under the spring force of the compression coil spring 18, but the second moveable block 16 is unable to return to its initial position due to the engagement between the latch member 35 and the striker portion 28. As the first moveable block 15 moves toward its initial position, the unlatch member 37 contacts the latch member 35 and depresses the latter into the cavity 34, thereby disengaging the latch member 35 from the striker portion 38. In this way, the second moveable block 16 follows the returning motion of the first moveable block 15, and the desired time lag between the disengagement of the contact point set for the load and the contact point set for shutting off the leak current of the triacs 60 is produced.

Figure 5:
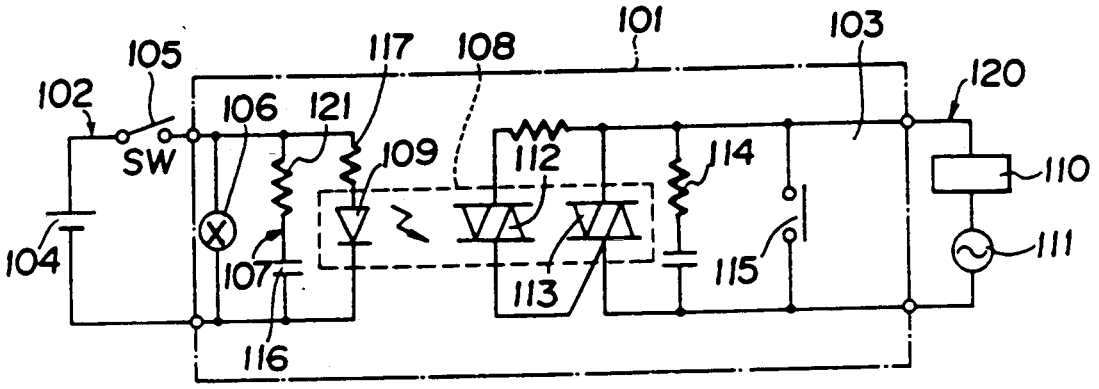
FIG. 5 is a circuit diagram of a conventional hybrid relay.
Figure 14:
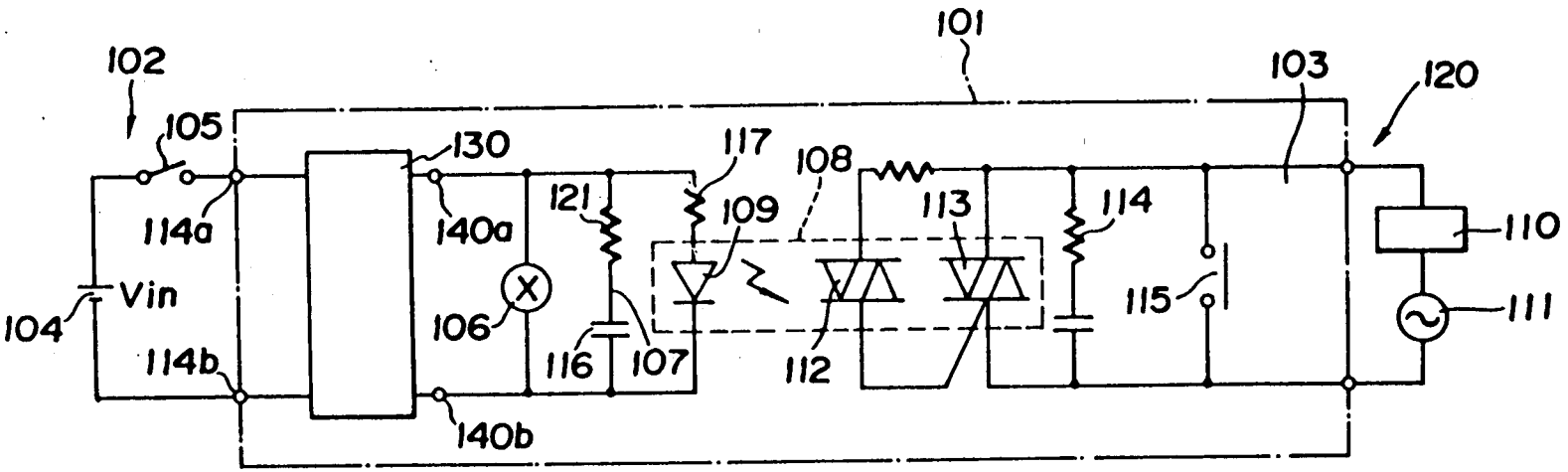
FIG. 14 is a simplified circuit diagram of a third embodiment of the hybrid relay of the present invention.
Figure 15:
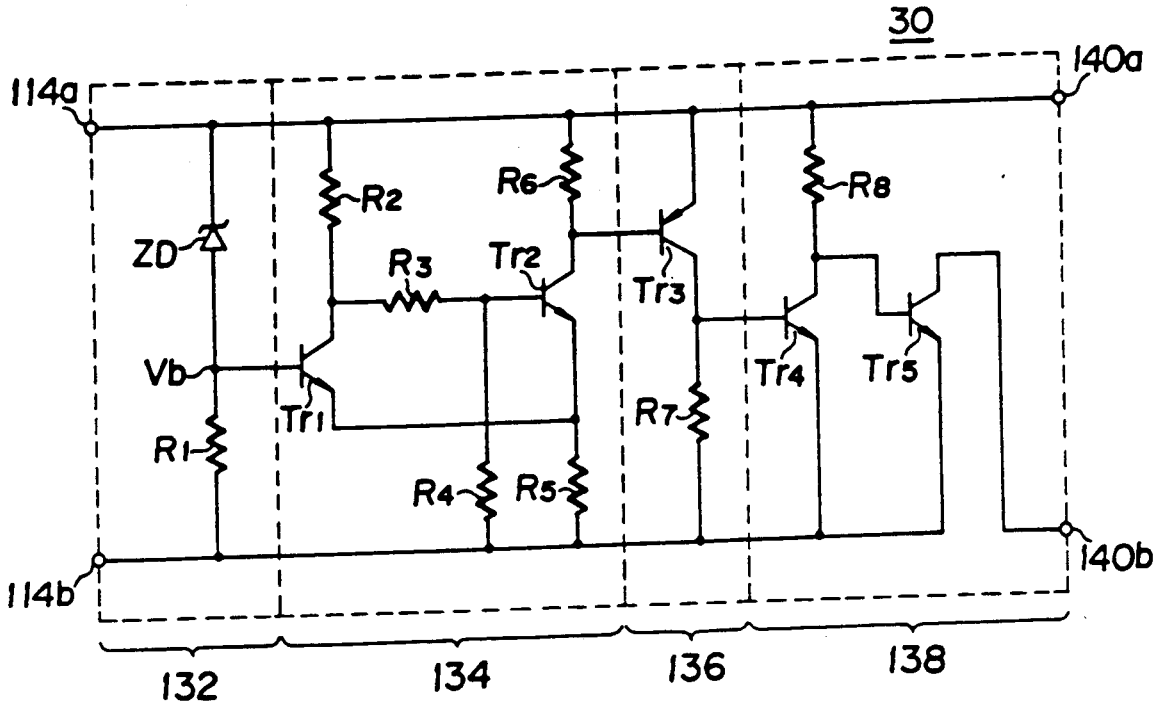
FIG. 15 is a detailed circuit diagram of the edge conditioning circuit included in the circuit diagram of FIG. 14.
Figure 16:
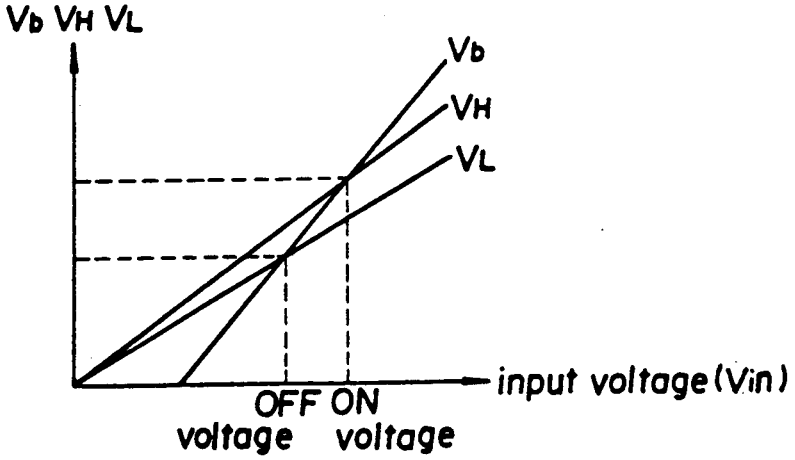
FIG. 16 is a graph for showing the operation of the circuit given in FIG. 15.

FIGS. 14 through 16 show a third embodiment of the present invention which is applied to a hybrid relay for controlling a single-phase AC motor. The circuit structure is substantially identical to that of the conventional hybrid relay shown in FIG. 5 except for the provision of a pulse edge conditioning circuit 130. Again, like parts are denoted with like numerals.

A primary feature of the present invention is found in that a pulse edge conditioning circuit 130 is interposed between input terminals 114*a* and 114*b* and terminals 140*a* and 140*b* leading to the timer circuit 107 in the input end of the hybrid relay so as to detect the input voltage from the control power source 104 and to produce an output voltage whose level sharply changes when the detected level of the input voltage has reached a prescribed reference value.

Now the structure of this pulse edge conditioning circuit 130 is described in greater detail with reference to FIG. 2.

The pulse edge conditioning circuit 130 comprises a non-linear circuit 132, a Schmitt circuit 134, a voltage reference compensation circuit 136 and an inverting amplification circuit 138. The non-linear circuit 132 comprises a zener diode ZD and a divider resistor R1. The Scnmitt circuit 134 comprises first and second transistors Tr1 and Tr2 of the NPN type and resistors R2, R3, R4, R5 and R6. The reference voltages $V_H$ and $V_L$ of the Schmitt trigger circuit 134 connected to the node between the zener diode ZD and the resistor R1 at which the output level changes over from off to on and from on to off, respectively, are determined by the current amplification factors of the first and second transistors Tr1 and Tr2, and the values of the resistors R2, R3, R4 and R5. Further, the reference voltage $V_L$ where the output voltage changes over from on to off is selected to be substantially higher than the on-off point of the the photo-coupler 117. The voltage reference compensation circuit 136 comprises a third transistor Tr3 of the PNP type and a resistor R7. In this voltage reference compensation circuit 136, the third transistor Tr3 is connected in series with the second transistor Tr2 of the Schmitt trigger circuit 134 having the opposite polarity as its load, and this not only eliminates the instability in the rising of the voltage but also prevents the generation of a residual voltage when the second transistor Tr3 turns on. Further, the inverting amplification circuit 138 comprises fourth and fifth transistors Tr4 and Tr5 and a resistor R8. The output terminals 140*a* and 140*b* of the pulse edge conditioning circuit 130 are connected to the terminal 114*a* and the collector of the transistor Tr5, respectively.

Now the operation of the pulse edge conditioning circuit 130 is described in the following.

When the relay drive switch 105 is turned on, the input voltage Vin from the control power source 104 is applied to the input terminals 114*a* and 114*b* of the pulse edge conditioning circuit 130. The voltage level of the node between the zener diode ZD and the resistor R1 which determines the base voltage Vb of the first transistor Tr1 of the Schmitt circuit 134 becomes larger with the increase in the input voltage Vin after exceeding the zener voltage. The reference voltages $V_H$ and $V_L$ at which the output level of the Schmitt circuit 134 changes over also progressively increases with the increase in the input voltage Vin. In this case, since the gradients of the changes in the base voltage Vb and the reference voltages $V_H$ and $V_L$ differ from one another, the second transistor Tr2 abruptly turns on when the base voltage Vb has exceeded the reference voltage $V_H$ with the change in the input voltage Vin. This in turn causes the third transistor Tr3 of the voltage reference compensation circuit 136 to be turned off, and the fifth transistor Tr5 of the inverting amplification circuit 138 to be turned on. As a result, a voltage is abruptly applied to the relay coil 106 and the light emitting element 109 of the phototriac 108.

Meanwhile, when the relay drive switch 102 is turned off and the input voltage Vin from the control power source 104 gradually decreases, the base voltage Vb of the first transistor Tr1 of the Schmitt circuit 134 and the reference voltages $V_H$ and $V_L$ accordingly diminish. When the base voltage Vb has fallen below the reference voltage $V_L$, the second transistor Tr2 of the Schmitt circuit 134 abruptly turns on. This in turn causes the third transistor Tr3 of the voltage reference compensation circuit 136 to be turned on, and the fifth transistor Tr5 of the inverting amplification circuit 138 to be turned off. As a result, the application of voltage to the relay coil 106 and the light emitting element 109 of the photo-triac 108 is abruptly discontinued.

Thus, since the output level of the pulse edge conditioning circuit 130 changes abruptly even when the input voltage Vin from the control power source 104 changes gradually, the operation timing between the contact mechanisms is always kept in the proper order.

Thus, the connection and disconnection of a contact mechanism is desired to be carried out in as short a time as possible, but, when the voltage of the relay drive power source changes gradually, it becomes difficult because the attractive force of the relay coil and the spring force of the return spring balance out one another. Particularly when there are a plurality of contact mechanisms, it is very difficult to make the operation timings of the different contact mechanisms agree one another because the spring forces and the magnetic attractive forces may well vary from one contact mechanism to another. However, if the pulse edge conditioning circuit 130 of the present invention is employed, since the output level of the pulse edge conditioning circuit 130 changes abruptly, the connection and disconnection of the contact points is carried out instantaously in each of the contact mechanisms. This contributes to the improvement of the durability of the relay.

What we claim is:

1. A hybrid relay comprising a mechanical relay provided with mechanical contact means adapted to be actuated by an electromagnet, a semiconductor relay including a semiconductor device, and switch means for supplying a drive current to said electromagnet, wherein said contact mechanism comprises:

a first contact mechanism having a first contact point set for controlling a load current of said hybrid relay;

a second contact mechanism having a second contact point set for controlling a control current for a control gate of said semiconductor relay;

a third contact mechanism having a third contact point set for controlling a leak current of said semiconductor relay;

a contact point gap of said first contact point set of said first contact mechanism being larger than a contact point gap of said second contact point set of said second contact mechanism, and a contact point gap of said third contact point set being smaller than said contact point gap of said second contact point set;

means for delaying the disengagement of said third contact point set when said electromagnet is deenergized; and a pair of carriers which are capable of independent motion along their direction of action, and one of said carriers carrying said first and second contact point sets is provided with pushing means for pushing the other carrier carrying said third contact point set to its activated position for engaging said third contact point set when said electromagnet is energized, said delay means comprising an auxiliary electromagnet which holds said other carrier at its activated position for a certain time interval after said one carrier has moved towards its initial position for disengaging said first and second contact point sets when said electromagnet is deenergized.

2. A hybrid relay as defined in claim 1, wherein said auxiliary electromagnet and an associated diode are connected in parallel with said electromagnet for moving said carriers.

3. A hybrid relay comprising a mechanical relay provided with mechanical contact means adapted to be actuated by an electromagnet, a semiconductor relay including a semiconductor device, and switch means for supplying a drive current to said electromagnet, wherein said contact mechanism comprises:

a first contact mechanism having a first contact point set for controlling a load current of said hybrid relay;

a second contact mechanism having a second contact point set for controlling a control current for a control gate of said semiconductor relay;

a third contact mechanism having a third contact point set for controlling a leak current of said semiconductor relay;

a contact point gap of said first contact point set of said first contact mechanism being larger than a contact point gap of said second contact point set of said second contact mechanism, and a contact point gap of said third contact point set being smaller than said contact point gap of said second contact point set;

means for delaying the disengagement of said third contact point set when said electromagnet is de-energized; and a pair of carriers which are capable of independent motion along their direction of action, and one of said carriers carrying said first and second contact point sets is provided with pushing means for pushing the other carrier carrying said third contact point set to its activated position for engaging said third contact point set when said electromagnet is energized, said delay means comprising latch means which engages said other carrier at its activated position for engaging said third contact point set and disengaging said other carrier from said activated position when said one carrier has returned a certain distance from its activated position for engaging said first and second contact point sets towards said initial position thereof and unlatching means carrier by said one carrier unlatches said latch means following de-energization of said electromagnet.

* * * * *